US006086343A

United States Patent [19]

Sun et al.

[11] Patent Number: 6,086,343

[45] Date of Patent: Jul. 11, 2000

[54] SEALED COMPRESSOR MOUNTED BETWEEN HORIZONTAL AND VERTICAL

[75] Inventors: Zili Sun, Arkadelphia, Ark.; Joe T. Hill, Bristol, Va.; Michael R. Young, Bristol, Tenn.

[73] Assignee: Scroll Technologies, Arkadelphia, Ak.

[21] Appl. No.: 09/106,700

[22] Filed: Jun. 29, 1998

[51] Int. Cl.[7] ..... F04C 18/00

[52] U.S. Cl. ..... 418/55.6; 418/94; 418/55; 184/6.18; 184/6.16; 184/6.13; 184/6.2

[58] Field of Search ..... 418/55.6, 94, 55; 184/6.18, 6.16, 6.13, 6.2

[56] References Cited

U.S. PATENT DOCUMENTS

| | | | |
|---|---|---|---|
| 3,687,233 | 8/1972 | Greenwald | 184/6.18 |
| 4,734,020 | 3/1988 | Inaba et al. | 418/55 |
| 5,037,278 | 8/1991 | Fujio et al. | 418/55.6 |

FOREIGN PATENT DOCUMENTS

| | | | |
|---|---|---|---|
| 574104A1 | 12/1993 | European Pat. Off. . | |
| 716231A1 | 12/1996 | European Pat. Off. . | |
| 0096487 | 4/1989 | Japan | 418/55.6 |
| 0096488 | 4/1989 | Japan | 418/55.6 |
| 0096490 | 4/1989 | Japan | 418/55.6 |
| 208357 | 8/1995 | Japan . | |

OTHER PUBLICATIONS

European Search Report, completed at The Hague, dated Sep. 30, 1999, by Examiner P. Dimitroulas.

Explanatory Note, dated Jul. 1997.

Japanese Patent Abstract, publication No. 07208357, dated Aug. 8, 1995.

Japanese Patent Abstract, publication No. 06058282, dated Jan. 3, 1994.

Japanese Patent Abstract, publication No. 58192993, dated Oct. 11, 1983.

Japanese Patent Abstract, publication No. 01096488, dated Apr. 14, 1989.

*Primary Examiner*—Thomas Denion

*Assistant Examiner*—Thai-Ba Trieu

*Attorney, Agent, or Firm*—Howard & Howard

[57] ABSTRACT

A scroll compressor is mounted at an angle between vertical and horizontal. In this way, the overall height of the compressor is reduced compared to a vertical compressor. Thus, when only a smaller vertical size is available for mounting, the compressor will be useable. On the other hand, if the compressor were mounted directly horizontally, problems would arise with regard to providing proper lubrication. Since the compressor housing is angled, oil collects at an end of the housing remote from the pump unit. An oil delivery system is also provided including an oil slinger to deliver oil into an oil reservoir. An oil pickup tube associated with the shaft is received in the oil reservoir and delivers lubricant to locations along the shaft as needed.

20 Claims, 3 Drawing Sheets

SEALED COMPRESSOR MOUNTED BETWEEN HORIZONTAL AND VERTICAL

BACKGROUND OF THE INVENTION

This invention relates to a scroll compressor mounted at an angle between the vertical and horizontal.

Sealed compressors are known wherein a housing or canister encloses a compressor pump unit. A quantity of oil is deposited within the canister, and the oil is supplied to various portions of the compressor, its associated motor, shaft, bearings, etcetera. Often, the canister is mounted such that its shaft and motor extend vertically. With such an arrangement, the oil collects in the bottom of the compressor. Thus, upon startup, there is a sufficient quantity of oil available near the bottom of the canister.

In some applications, due to size restrictions, a vertically extending compressor cannot be utilized. In such applications, it has been proposed to mount the compressor such that it extends horizontally. That is, when there is insufficient room for the compressor to extend vertically, they have sometimes been mounted horizontally.

However, when the compressor is mounted horizontally, the oil collects along the entire length of the canister. This may be undesirable, as there may not be a sufficient level of oil in the canister to properly lubricate the compressor.

In addition, certain types of compressors are particularly effected by this arrangement being immersed in oil. As an example, in a scroll compressor which is horizontally mounted, the scroll wrap units may actually be received in the oil level if the compressor is mounted horizontally. This is undesirable, as an unduly large quantity of oil may enter the scroll chambers.

SUMMARY OF THE INVENTION

In a disclosed embodiment of this invention, the compressor canister is mounted at an angle which is non-parallel to horizontal, and non-parallel to vertical. Preferably, the central axis of the canister is mounted such that it is between 0 and 60 degrees relative to the horizontal. In this way, oil still collects in a rear portion of the canister, however, the overall height required is reduced.

In a preferred embodiment of this invention, oil is supplied to the compressor components by an oil pickup tube extending from an end of the shaft remote from the pump unit.

Preferably, an oil supply slinger is mounted to the shaft forwardly of the oil pickup unit. The slinger is rotated through the quantity of oil and moves the oil into an oil reservoir spaced vertically above the bottom of the canister.

Preferably, the oil reservoir is formed by a housing portion extending inwardly from an end cap. The reservoir is preferably formed by a lower wall extending at an angle which moves downwardly relative to the oil pickup tube, at an angle which is parallel to the horizontal and non-parallel to the axis of the shaft. In this way, a sufficient quantity of oil is ensured to be received in the reservoir. The oil pickup tube extends rearwardly into the reservoir, and an end of the oil pickup tube should always be immersed in oil. Thus, at startup, there will always be oil available for the oil pickup tube. Due to the oil slinger, there will always be a good quantity of oil in the reservoir. In fact, the oil slinger is preferably designed such that it moves more oil into the reservoir than is being removed by the oil pickup tube or any leakage.

Most preferably, this arrangement is utilized in a scroll compressor unit. The scroll wraps are positioned out of the normal oil level when the compressor is shut down. That is, since the canister is angled downwardly away from the pump unit, the oil collects in the opposed side of the canister, away from the scroll wraps. This improves the operation of the compressor.

These and other features of the present invention can be best understood from the following specification and drawings, the following of which is a brief description.

DETAILED DESCRIPTION OF A PREFERRED EMBODIMENT

Figure 1:
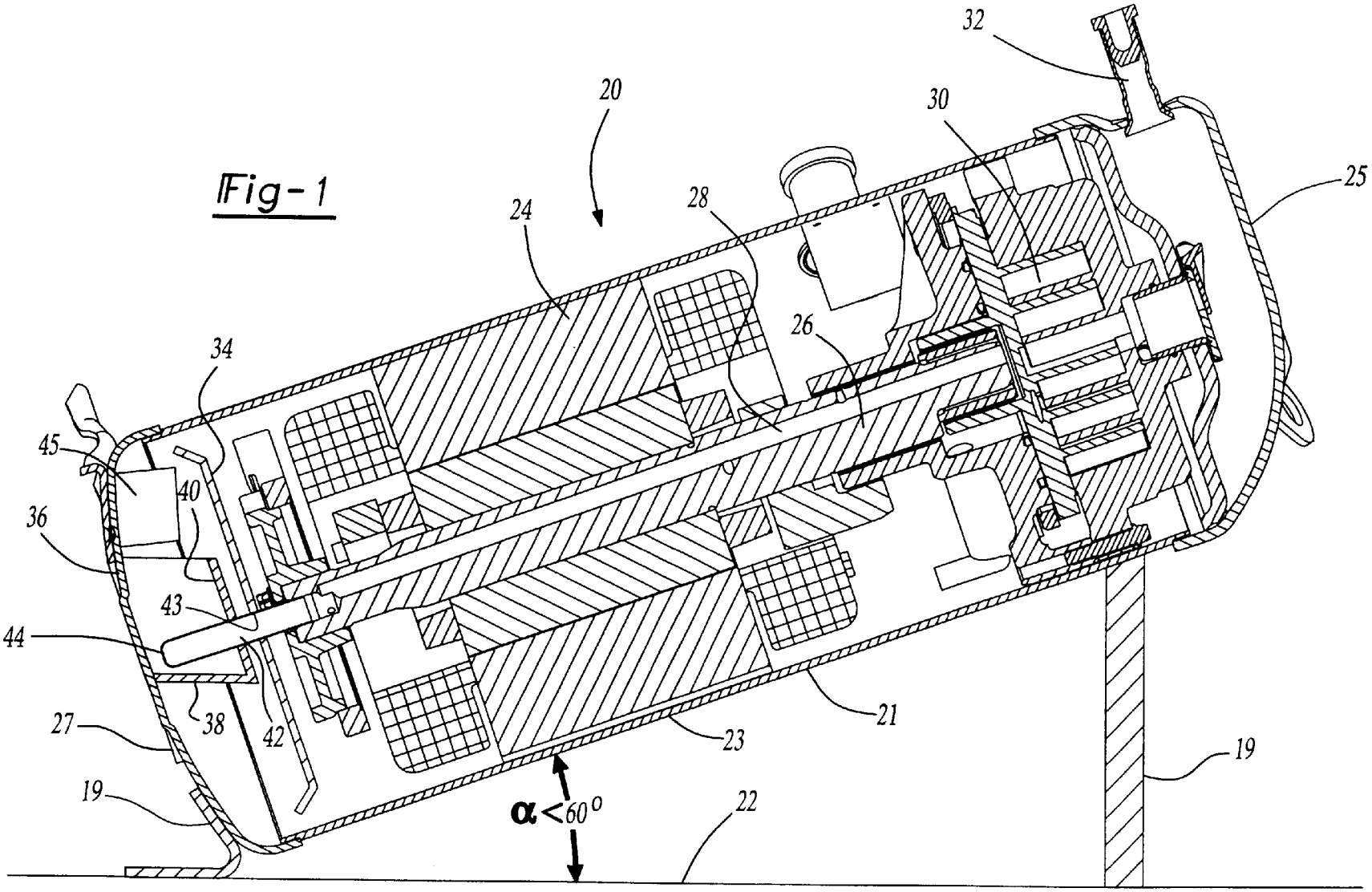
FIG. 1 shows a cross-sectional view through a scroll compressor and its housing.

A compressor 20 is shown in FIG. 1, having a housing 21 of the type which is sealed such that the refrigerant can circulate within the housing body. As an example, a tubular housing portion 23 extends generally along an axis and has end caps 25 and 27 at each end.

As shown, the compressor 20 is mounted at an angle relative to the ground 22. The compressor is shown supported by brackets 19. It should be understood that in practice, the compressor 20 could be mounted by any type of structure, and that brackets 19 are only shown as an example.

The angle between the housing 21 and the ground 22 is preferably between 90 degrees and zero degrees. More preferably, it is between 0 and 60 degrees. In a most preferred embodiment, the angle is 10–25 degrees.

As shown, a central shaft 26 is driven by a motor 24. Shaft 26 includes an oil passage 28 extending along the shaft to a pump unit 30. In the illustrated embodiment, the pump unit 30 is a scroll compressor unit having fixed and orbiting scrolls which orbit to compress a fluid and drive it to a discharge port 32.

The end cap 27 is positioned remote from pump unit 30. An oil slinger 34 is mounted at the end of the shaft, and adjacent to an oil reservoir formed by a structure 38. The oil reservoir structure 38 has a vertically upwardly extending end wall 40. An oil pickup tube 42 extends through an opening 43 in wall 40 and is rotatably mounted within wall 40. An inlet end 44 of the oil pickup tube 42 is received in a reservoir housing. A baffle 45 is positioned above structure 38, for a purpose explained below.

Figure 2:
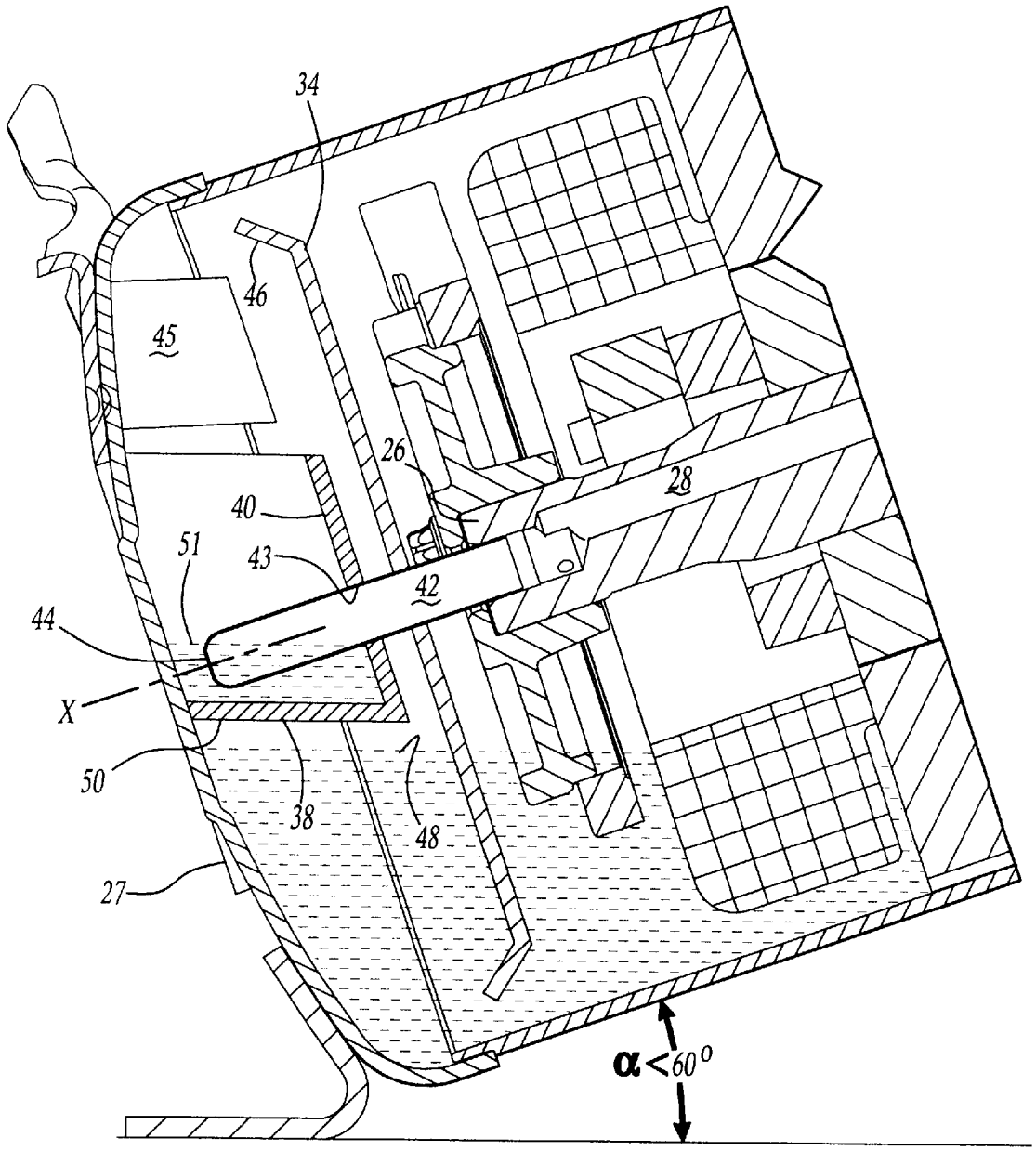
FIG. 2 is an enlarged view of one end of the compressor shown in FIG. 1.

FIG. 2 shows the oil supply structure for this invention. As shown, the oil slinger 34 is provided with a frusto-conically extending portion 46. This portion 46 rotates within the lubricant, the level 48 of which is shown for when the compressor is not running. Thus, the oil slinger 46 rotates within the lubricant 48 and delivers it upwardly into the reservoir 38. As shown, the level 51 of lubricant within the reservoir 38 is relatively high such that the inlet 44 for the pickup tube is submerged when the compressor has stopped running. When the compressor is running, the oil slinger 46 is designed, along with the flow through the pickup tube 42, such that more oil is delivered to the reservoir 38 than is removed by leakage or by flow through the tube 42.

Now, due to the angled mount of the compressor, the oil level 48 is contained near one end of the compressor such that the pump unit 30 is not submerged in oil. On the other hand, the arrangement of the reservoir is such that it is also ensured that there will be oil adjacent to the pickup tube 42 when the compressor is started.

As shown, the bottom wall 50 of the reservoir is angled along a plane which is non-parallel to the axis x of the shaft 30. The wall 50 extends inwardly from the end cap 27. Preferably, the wall is parallel to the horizontal. This ensures that the oil level adjacent the rear of the reservoir, where the opening 44 is received, will be sufficient to ensure the opening 44 is submerged.

Figure 3:
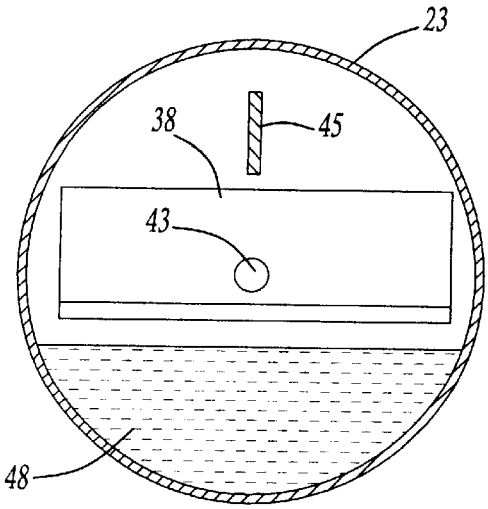
FIG. 3 is a cross-section through the compressor of FIG. 2.

FIG. 3 shows baffle 45 above reservoir 38. Baffle 45 removes oil slung by slinger 34 that might otherwise pass over reservoir 38.

Figure 4:
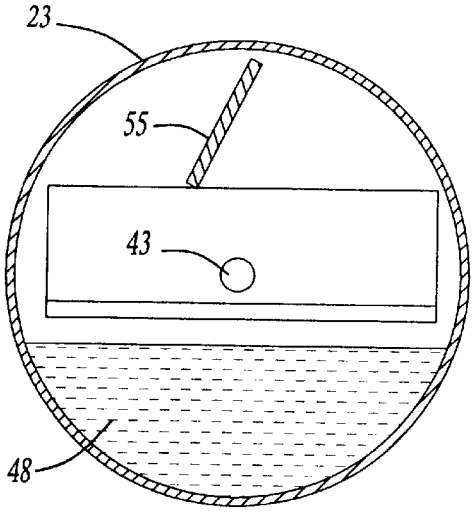
FIG. 4 is a view similar to FIG. 3, but showing a distinct embodiment.

FIG. 4 shows an embodiment in which the baffle plate 53 extends at an angle to the horizontal. The baffle plates in both embodiments extends along a direction which includes a vertical component. However, baffle plate 53 also includes a horizontal component. That is, it is angled relative to the horizontal. This angling may make the baffle more effective in removing the oil downwardly into the reservoir.

Figure 5:
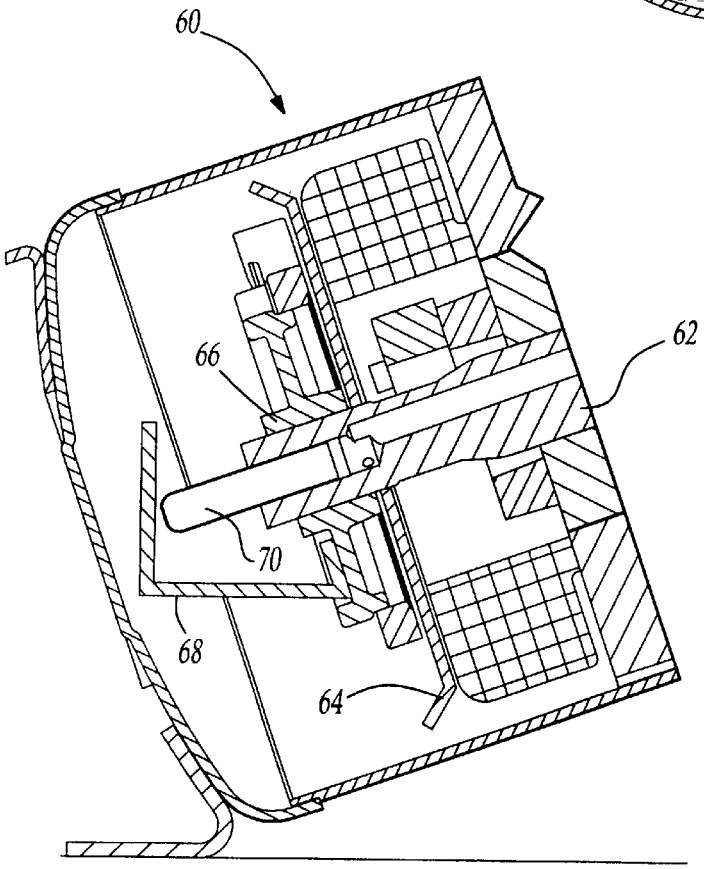
FIG. 5 is a view similar to FIG. 2, but showing a distinct embodiment.

FIG. 5 shows an embodiment 60, wherein a shaft 62 mounts the slinger 64. That is, in this embodiment the slinger is mounted to the shaft rather than the oil pickup tube as in the prior embodiment.

Further, the lower bearing 66 mounts the reservoir 68, and the oil pickup tube 70 extends into the reservoir 68. The embodiment is somewhat schematically, however, it preferably has structure and arrangement similar to that shown to the earlier embodiments.

The present invention ensures that the compressor will not require the vertical mounting, and can be utilized in applications which have less vertical space, while still ensuring proper operation of the compressor. The invention is particularly well-suited to scroll compressors which are more adversely affected by the ingress of oil into the compression chambers than other types of compressors. Also, while the compressor is shown at an angle relative to the horizontal, it would extend also to compressors mounted extending directly horizontally.

A preferred embodiment of this invention has been disclosed, however, a worker of ordinary skill in the art would recognize that certain modifications would come within the scope of this invention. For that reason, the following claims should be studied to determine the true scope and content of this invention.

What is claimed is:

1. A sealed compressor comprising:

a housing extending generally along an axis;

an electric motor and a pump unit received within said housing, said electric motor driving a shaft to drive said pump unit;

said shaft being provided with an oil passage along at least a portion of the length of said shaft;

an oil reservoir communicating with said oil passage, said oil reservoir being positioned vertically above a vertically bottom-most wall of said housing;

said housing axis being non-parallel to a horizontal plane, and non-perpendicular to said horizontal plane; and said oil reservoir being provided by a housing fixed to an end cap of said housing at an end remote from said pump unit, said reservoir including a bottom wall which extends along a plane which is non-parallel to a central axis of said shaft.

2. A compressor as recited in claim 1, wherein said pump unit is a scroll compressor unit.

3. A compressor as recited in claim 1, wherein said axis is at an angle of between 0 and 60 degrees relative to the horizontal.

4. A compressor as recited in claim 1, wherein said reservoir is fixed to an end cap of said housing.

5. A compressor as recited in claim 4, wherein said reservoir is fixed to a bearing which supports said shaft.

6. A compressor as recited in claim 1, wherein said bottom wall extends from said end cap and downwardly away from said central axis of said shaft.

7. A compressor as recited in claim 6, wherein an inner wall of said reservoir extends upwardly from said bottom wall to define said reservoir.

8. A compressor as recited in claim 7, wherein an oil pickup tube extends rearwardly from said shaft, and has an inlet at an end spaced away from said pump unit, said oil reservoir containing a sufficient amount of lubricant such that said inlet of said oil pickup tube is submerged in oil when said compressor is stopped.

9. A compressor as recited in claim 8, wherein an oil slinger is fixed to said pickup tube and rotates within a quantity of lubricant received in a bottom portion of said housing.

10. A compressor as recited in claim 9, wherein a baffle is positioned extending generally vertically, and above said reservoir.

11. A compressor as recited in claim 10, wherein said baffle direction also includes a horizontal component.

12. A sealed compressor comprising:

a housing extending generally along an axis;

an electric motor and a pump unit received within said housing, said electric motor driving a shaft to drive said pump unit;

said shaft being provided with an oil passage along at least a portion of the length of said shaft;

an oil reservoir communicating with said oil passage, said oil reservoir being positioned vertically above a vertically bottom-most wall of said housing;

said housing axis being non-parallel to a horizontal plane, and non-perpendicular to said horizontal plane; and said oil reservoir being provided by a housing fixed to an end cap of said housing at an end remote from said pump unit, wherein said reservoir includes a bottom wall which extends along a plane which is parallel to the horizontal.

13. A scroll compressor comprising:

a housing extending generally along an axis;

an electric motor and a scroll pump unit received within said housing, said electric motor driving a shaft to said pump unit;

said shaft being provided with an oil passage along a portion of the length of said shaft;

an oil reservoir communicating with said oil passage, said oil reservoir being positioned vertically above a vertically bottom-most wall of said housing;

said housing axis being non-perpendicular to a horizontal plane; and said oil reservoir being provided by a housing fixed to an end cap of said housing and at an end remote from said scroll pump unit, said reservoir including receiving an oil pickup tube which extends rearwardly from said shaft, said oil pickup tube having an inlet at an end space from said scroll pump unit, said oil reservoir containing a sufficient amount of lubricant such that said inlet of said oil pickup tube is submerged in said oil when said compressor is stopped, and an oil slinger being fixed to rotate within a quantity of lubricant received in a bottom portion of said housing.

14. A scroll compressor as recited in claim 13, wherein said housing axis is non-parallel to the horizontal, and between 0 and 60 degrees.

15. A scroll compressor as recited in claim 13, wherein said reservoir including a bottom wall which extends along a plane which is non-parallel to a central axis of said shaft.

16. A scroll compressor as recited in claim 15, wherein said bottom wall extends along a plane which is parallel to the horizontal.

17. A scroll compressor as recited in claim 13, wherein a baffle is positioned to extend in a direction with a vertical component, and above said reservoir.

18. As scroll compressor as recited in claim 17, wherein said direction of said baffle includes a horizontal component.

19. A scroll compressor as recited in claim 13, wherein said oil slinger is fixed to said oil pickup tube.

20. A scroll compressor as recited in claim 13, wherein said slinger is fixed to said shaft.

* * * * *